US009879623B2

(12) United States Patent
Dekar et al.

(10) Patent No.: US 9,879,623 B2
(45) Date of Patent: Jan. 30, 2018

(54) EVAPORATIVE EMISSIONS CONTROL SYSTEM INCLUDING A PURGE PUMP AND HYDROCARBON SENSOR

(71) Applicants: Joseph Dekar, Jackson, MI (US); Roger C Sager, Munith, MI (US); James J Daley, Jackson, MI (US); William B Blomquist, Lake Orion, MI (US); Jeffrey P Wuttke, Sterling Heights, MI (US); Russell J Wakeman, Canton, MI (US); Adam Fleischman, White Lake, MI (US); Ronald A Yannone, Jr., Clinton, MI (US); Luis Del Rio, Ann Arbor, MI (US); Mark L Lott, Webberville, MI (US); Edward Baker, Livonia, MI (US); Michael T Vincent, Novi, MI (US); Wei-Jun Yang, Ann Arbor, MI (US); Aikaterini Tsahalou, Shelby Township, MI (US)

(72) Inventors: Joseph Dekar, Jackson, MI (US); Roger C Sager, Munith, MI (US); James J Daley, Jackson, MI (US); William B Blomquist, Lake Orion, MI (US); Jeffrey P Wuttke, Sterling Heights, MI (US); Russell J Wakeman, Canton, MI (US); Adam Fleischman, White Lake, MI (US); Ronald A Yannone, Jr., Clinton, MI (US); Luis Del Rio, Ann Arbor, MI (US); Mark L Lott, Webberville, MI (US); Edward Baker, Livonia, MI (US); Michael T Vincent, Novi, MI (US); Wei-Jun Yang, Ann Arbor, MI (US); Aikaterini Tsahalou, Shelby Township, MI (US)

(73) Assignee: FCA US LLC, Auburn Hills, MI (US)

( * ) Notice: Subject to any disclaimer, the term of this patent is extended or adjusted under 35 U.S.C. 154(b) by 0 days.

(21) Appl. No.: 15/164,462

(22) Filed: May 25, 2016

(65) Prior Publication Data

US 2017/0342919 A1 Nov. 30, 2017

(51) Int. Cl.
*F02M 25/08* (2006.01)
*F02D 41/00* (2006.01)
(Continued)

(52) U.S. Cl.
CPC ..... *F02D 41/0045* (2013.01); *F02D 41/021* (2013.01); *F02M 25/089* (2013.01);
(Continued)

(58) Field of Classification Search
CPC ..... F02M 25/08–25/089
(Continued)

(56) References Cited

U.S. PATENT DOCUMENTS 3,888,223 A 6/1975 Mondt
5,390,645 A 2/1995 Cook et al.
(Continued)

FOREIGN PATENT DOCUMENTS

WO 2015049157 A1 4/2015

*Primary Examiner* — Erick Solis
(74) *Attorney, Agent, or Firm* — Ralph E Smith

(57) ABSTRACT

An evaporative emissions (EVAP) control system for a vehicle includes a purge pump configured to pump fuel vapor trapped in a vapor canister to an engine of the vehicle via a vapor line when engine vacuum is less than an appropriate level for delivering fuel vapor to the engine, the fuel vapor resulting from evaporation of a liquid fuel stored in a fuel tank of the engine. The EVAP control system includes a hydrocarbon (HC) sensor disposed in the vapor line and configured to measure an amount of HC in the fuel vapor pumped by the purge pump to the engine via the vapor line. The EVAP control system also includes a controller
(Continued)

configured to, based on the measured amount of MC, control at least one of the purge pump and a purge valve to deliver a desired amount of fuel vapor to the engine.

15 Claims, 2 Drawing Sheets

(51) Int. Cl.
*F02M 35/10* (2006.01)
*F02D 41/02* (2006.01)

(52) U.S. Cl.
CPC .... *F02M 25/0818* (2013.01); *F02M 25/0827* (2013.01); *F02M 25/0836* (2013.01); *F02M 25/0854* (2013.01); *F02M 35/10222* (2013.01)

(58) Field of Classification Search
USPC ..... 123/516, 518–521
See application file for complete search history.

(56) References Cited

U.S. PATENT DOCUMENTS 5,957,113 A * 9/1999 Masaki ..... F02M 25/089 123/518
6,318,345 B1 11/2001 Weber et al.
6,321,727 B1 11/2001 Reddy et al.
7,077,112 B2 7/2006 Mitani et al.
7,546,825 B2 * 6/2009 Keeton ..... F02D 41/062 123/179.9
7,566,358 B2 7/2009 Hart et al.
8,689,613 B2 4/2014 Perry
9,206,773 B2 * 12/2015 Menke ..... B60K 15/03519
2002/0121270 A1 * 9/2002 Kano ..... F02M 25/08 123/520
2002/0162457 A1 * 11/2002 Hyodo ..... F02M 25/089 96/109
2003/0110836 A1 6/2003 Cho
2003/0196645 A1 * 10/2003 Kojima ..... F02M 25/089 123/520
2013/0174808 A1 * 7/2013 Kudo ..... F02M 37/0064 123/445
2015/0019066 A1 1/2015 Dudar et al.
2015/0083089 A1 3/2015 Pearce et al.
2016/0123254 A1 * 5/2016 Burleigh ..... F02D 41/004 123/520
2016/0131052 A1 * 5/2016 Makino ..... F02M 25/0836 123/520

* cited by examiner

EVAPORATIVE EMISSIONS CONTROL SYSTEM INCLUDING A PURGE PUMP AND HYDROCARBON SENSOR

FIELD

The present application generally relates to evaporative emissions (EVAP) control systems and, more particularly, to an EVAP control system including a purge pump and a hydrocarbon (HC) sensor.

BACKGROUND

Conventional evaporative emissions (EVAP) control systems include a vapor canister and vapor transport lines. The vapor canister traps fuel vapor that evaporates from liquid fuel (e.g., gasoline) stored in a fuel tank of the vehicle. Engine vacuum is utilized to deliver the fuel vapor from the vapor canister to the engine through the vapor transport lines and into intake ports of the engine. When an engine is off (e.g., during engine cold starts), however, there is no engine vacuum. The specific composition or concentration of the fuel vapor is also unknown. Accordingly, while such EVAP control systems work for their intended purpose, there remains a need for improvement in the relevant art.

SUMMARY

According to a first aspect of the invention, an evaporative emissions (EVAP) control system for a vehicle is presented. In one exemplary implementation, the EVAP control system includes a purge pump configured to pump fuel vapor trapped in a vapor canister to an engine of the vehicle via a vapor line when engine vacuum is less than an appropriate level for delivering fuel vapor to the engine, the fuel vapor resulting from evaporation of a liquid fuel stored in a fuel tank of the engine, a hydrocarbon (HC) sensor disposed in the vapor line and configured to measure an amount of HC in the fuel vapor pumped by the purge pump to the engine via the vapor line, and a controller configured to, based on the measured amount of HC, control at least one of the purge pump and a purge valve to deliver a desired amount of fuel vapor to the engine, the purge pump being connected between the purge pump and the engine.

In some implementations, the purge pump is configured to pump the fuel vapor during engine-off periods. In some implementations, the controller is configured to control at least one of the purge pump and the purge valve to deliver the desired amount of fuel vapor to the engine during cold starts in order to mitigate an amount of HC emissions. In some implementations, the purge valve is connected to an intake port of a cylinder of the engine. In other implementations, the purge valve is connected to the cylinder.

In some implementations, the controller is configured to control at least one of the purge pump and the purge valve based on a measured ambient temperature. In some implementations, a precondition for the controller controlling at least one of the purge pump and the purge valve is a key-on event of the vehicle. In some implementations, a precondition for the controller controlling at least one of the purge pump and the purge valve is a rotational speed of the purge pump exceeding a threshold.

In some implementations, a precondition for the controller controlling at least one of the purge pump and the purge valve is the HC sensor being turned on. In some implementations, the precondition further includes the measured amount of HC being greater than a minimum threshold for combustion by the engine. In some implementations, the controller is further configured to control fuel injectors of the engine to deliver the liquid fuel from the fuel tank after a period of controlling at least one of the purge pump and the purge valve to deliver the desired amount of fuel vapor to the engine.

In some implementations, the controller is configured to control both the purge pump and the purge valve to deliver the desired amount of fuel vapor to the engine. In some implementations, the controller is configured to control a rotational speed of the purge pump and an angular opening of the purge valve. In some implementations, the measured amount of HC in the fuel vapor is indicative of a portion of the fuel vapor that is combustible, and wherein the controller is configured to utilize the combustible portion of the fuel vapor in controlling at least one of the purge pump and the purge valve.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings referenced therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DETAILED DESCRIPTION

As previously discussed, conventional evaporative emissions (EVAP) control systems rely upon engine vacuum to deliver fuel vapor to the engine. These systems, therefore, may be inoperable for providing fuel vapor to the engine when the engine is off and there is no vacuum (e.g., during cold starts). Accordingly, improved EVAP control systems are presented. These EVAP control systems include a purge pump configured to pump fuel vapor that is captured in a vapor canister to the engine and a hydrocarbon (HC) sensor for measuring an amount of HC in the fuel vapor pumped by the purge pump.

By implementing the purge pump and the HC sensor, these EVAP control systems are configured to supply the engine with a desired amount of fuel vapor corresponding to a desired amount of HC. This is particularly useful, for example, during engine-off periods (e.g., engine cold starts) where no engine vacuum exists to supply the fuel vapor to the engine. A controller can control the purge pump and/or purge valves at intake ports of cylinders of the engine, such as based on the measured amount of HC in the fuel vapor, to deliver a desired amount of HC to the engine.

Engine emissions are also typically the greatest during engine cold starts. This is due to the fact that, during engine cold starts, engine components (lubricating fluids, catalysts, etc.) have not reached their optimal operating temperatures. The disclosed system/method enables fuel vapor to be combusted during engine cold starts, which increases combustion and decreases engine emissions (HC, nitrogen oxides (NOx), carbon monoxide (CO), etc.), in addition to warming up the engine components faster.

Figure 1:
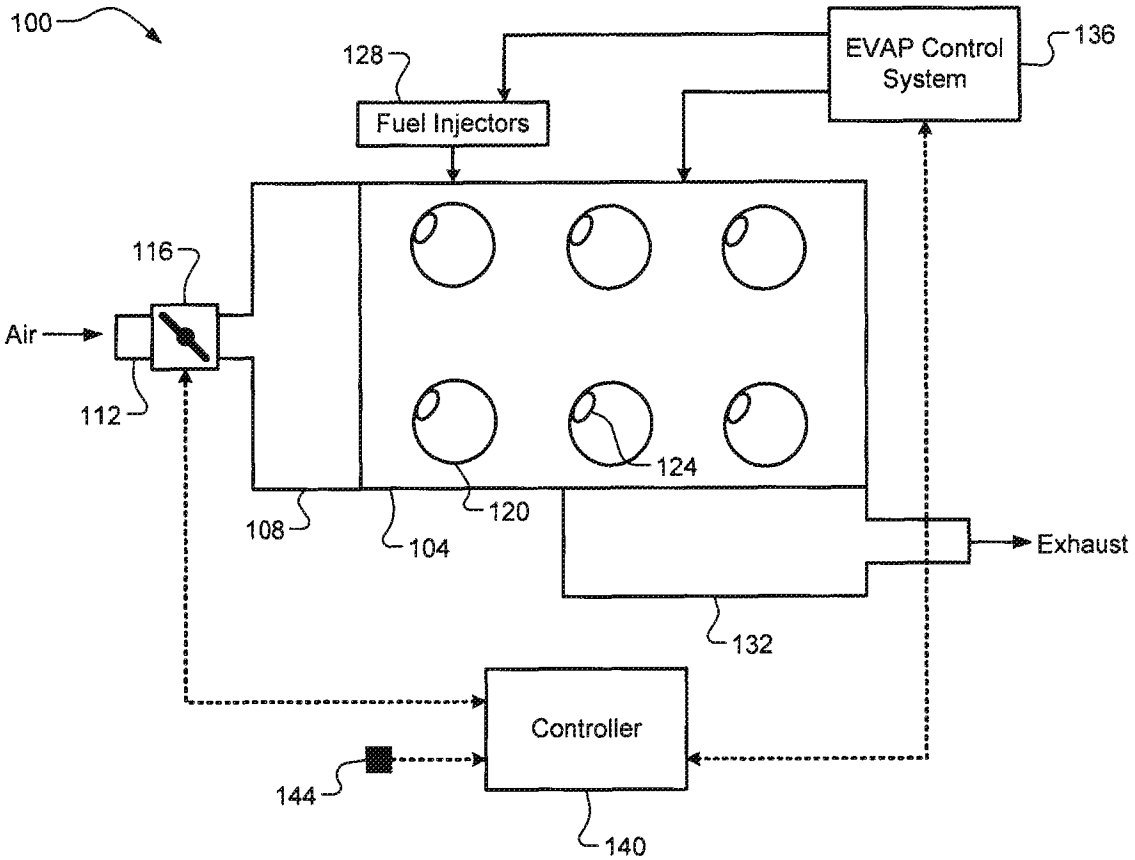
FIG. 1 is a diagram of an example engine system including an evaporative emissions (EVAP) control system according to the principles of the present disclosure.

Referring now to FIG. 1, an example engine system 100 is illustrated. The engine system 100 includes an engine 104 that is configured to combust an air/fuel mixture to generate drive torque. The engine draws air into an intake manifold 108 through an induction system 112 that is regulated by a throttle valve 116. The air in the intake manifold 108 is distributed to a plurality of cylinders 120 via respective intake ports 124. While six cylinders are shown, the engine 104 could have any number of cylinders. Fuel injectors 128 are configured to inject liquid fuel (e.g., gasoline) via the intake ports 124 (port fuel injection) or directly into the cylinders 120 (direct fuel injection). While not shown, it will be appreciated that the engine 104 could include other components, such as a boost system (supercharger, turbocharger, etc.).

Intake valves (not shown) control the flow of the air or air/fuel mixture into the cylinders 120. The air/fuel mixture is compressed by pistons (not shown) within the cylinders 120 and combusted (e.g., by spark plugs (not shown)) to drive the pistons, which rotate a crankshaft (not shown) to generate drive torque. Exhaust gas resulting from combustion is expelled from the cylinders 120 via exhaust valves/ports (not shown) and into an exhaust treatment system 132. The exhaust treatment system 132 treats the exhaust gas before releasing it into the atmosphere. An EVAP control system 136 selectively provides fuel vapor to the engine 104 via the intake ports 124. While delivery via the intake ports 124 is shown and discussed herein, it will be appreciated that the fuel vapor could be delivered to the engine 104 directly into the cylinders 120.

The EVAP control system 136 includes at least a purge pump (not shown) and an HC sensor (not shown). The EVAP control system 136 is controlled by a controller 140. The controller 140 is any suitable controller or control unit for communicating with and commanding the EVAP control system 136. In one exemplary implementation, the controller 140 includes one or more processors and a non-transitory memory storing a set of instructions that, when executed by the one or more processors, cause the controller 140 to perform a specific fuel vapor delivery technique. The controller 140 is configured to receive information from one or more vehicle sensors 144. Examples of the vehicle sensors 144 include an ambient pressure sensor, an altitude or barometric pressure sensor, an engine coolant temperature sensor, and a key-on sensor.

Figure 2:
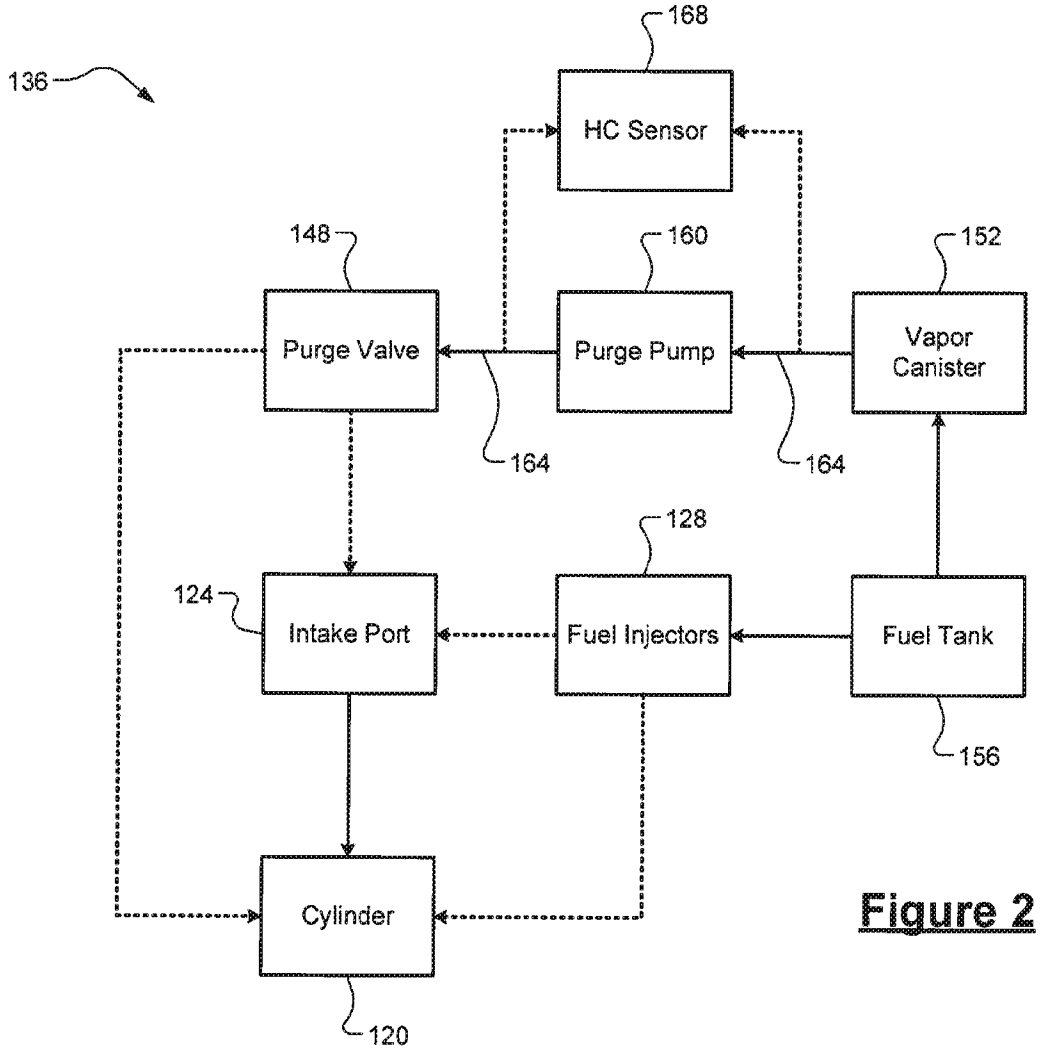
FIG. 2 is a functional block diagram of an example configuration of the EVAP control system according to the principles of the present disclosure.

Referring now to FIG. 2, a functional block diagram of an example configuration of the EVAP control system 136 is illustrated. While the EVAP control system 136 is only shown with respect to a single intake port 124 and single cylinder 120 of the engine 104, it will be appreciated that the fuel vapor could be supplied to all of the intake ports 124 and/or cylinders 120. The EVAP control system 136 is configured to deliver fuel vapor to the intake ports 124 of the engine 104 via purge valves 148. For example, the purge valves 148 could be disposed within holes or apertures in a wall of the intake ports 124. As previously mentioned, it will be appreciated that the purge valves 148 could be configured to deliver the fuel vapor directly to the cylinders 108, e.g., via different holes or apertures. One example of the purge valves is a butterfly-type valve, but it will be appreciated that any suitable valve configured to regulate the flow of pressurized fuel vapor could be utilized.

The EVAP control system 136 includes a vapor canister 152 that traps fuel vapor that evaporates from liquid fuel stored in a fuel tank 156. This fuel vapor can be directed from the fuel tank 156 to the vapor canister via an evaporation line or duct 154. In one exemplary implementation, the vapor canister includes (e.g., is lined with) activated carbon (e.g., charcoal) that adsorbs the fuel vapor. While not shown, the vapor canister 152 could further include a vent device (e.g., a valve) that allows fresh air to be drawn through the vapor canister 152, thereby pulling the trapped fuel vapor with it. As previously discussed, conventional EVAP control systems utilize engine vacuum to draw this fresh air (and trapped fuel vapor) through the system for engine delivery.

In the illustrated EVAP control system 136, a purge pump 160 is configured to selectively pump the fuel vapor from the vapor canister 152 through vapor lines 164 to the intake ports 124 (via the purge valves 148). This pumping could be in conjunction with or without the use of drawn fresh air through the vapor canister 152. The purge pump 160 could be any suitable pump configured to pump the fuel vapor from the vapor canister 152 through vapor lines 164. An HC sensor 168 is disposed in the vapor lines 164 and configured to measure an amount of HC in the fuel vapor pumped by the purge pump 160. As shown, the HC sensor 168 could measure the amount of HC flowing into and/or out of the purge pump 160. The measured amount of HC is indicative of an amount of the fuel vapor that is combustible. Rather, the HC in the fuel vapor represents the highly combustible component of the fuel vapor.

As the purge valves 148 regulate the flow of the fuel vapor into the engine 104, the controller 140 is configured to control at least one of the purge pump 160 and the purge valves 148 to deliver the desired amount of fuel vapor to the engine 104. The control of the purge pump 160 could include controlling its rotational speed. The control of the purge valves 148, on the other hand, could include controlling their angular opening. For example, there may be a high amount of HC present in highly pressurized fuel vapor in the vapor lines 164, and thus the controller 148 may primarily actuate the purge valves 148 to deliver the desired amount of fuel vapor. In many situations, however, the controller 160 will perform coordinated control of both the purge pump 160 and the purge valves 148 to deliver the desired amount of fuel vapor (e.g., a desired amount of HC) to the engine 104.

By delivering this highly combustible fuel vapor to the engine 104, combustion improves and emissions decrease. As previously discussed, the controller 140 is also configured to control the fuel injectors 128 to deliver the liquid fuel from the fuel tank 156 to the engine 104. This liquid fuel injection could be either port fuel injection or direct fuel injection. In one exemplary implementation, the controller 140 is further configured to control the fuel injectors 128 to deliver the liquid fuel from the fuel tank 156 after a period of controlling at least one of the purge pump 160 and the purge valves 148 to deliver the desired amount of fuel vapor to the engine 104. This period, for example only, could be a cold start of the engine 104.

Various preconditions could be implemented for operating the EVAP control system 136. In one exemplary implementation, the controller 140 is configured to control at least one of the purge pump 160 and the purge valves 148 based on a measured ambient temperature. Another exemplary precondition is detecting a key-on event of the vehicle. For example, these preconditions could be indicative of a cold start of the engine 104. Other exemplary preconditions could also be utilized, such as the rotational speed of the purge pump 160 reaching a desired level (e.g., where adequate pumping can occur) and the HC sensor 168 being turned on. Another exemplary precondition could include the HC sensor 168 measuring an amount of HC greater than a minimum threshold for combustion by the engine 104. In other words, if there is too little HC in the fuel vapor, there could be no combustion benefit by delivering the fuel vapor to the engine 104.

As previously discussed, it will be appreciated that the term "controller" as used herein refers to any suitable control device or set of multiple control devices that is/are configured to perform at least a portion of the techniques of the present disclosure. Non-limiting examples include an application-specific integrated circuit (ASIC), one or more processors and a non-transitory memory having instructions stored thereon that, when executed by the one or more processors, cause the controller to perform a set of operations corresponding to at least a portion of the techniques of the present disclosure. The one or more processors could be either a single processor or two or more processors operating in a parallel or distributed architecture.

It should be understood that the mixing and matching of features, elements, methodologies and/or functions between various examples may be expressly contemplated herein so that one skilled in the art would appreciate from the present teachings that features, elements and/or functions of one example may be incorporated into another example as appropriate, unless described otherwise above.

What is claimed is:

1. An evaporative emissions (EVAP) control system for a vehicle, the EVAP control system comprising:

a purge pump configured to pump fuel vapor trapped in a vapor canister to an engine of the vehicle via a vapor line, the fuel vapor resulting from evaporation of a liquid fuel stored in a fuel tank of the engine;

a hydrocarbon (HC) sensor disposed in the vapor line and configured to measure an amount of HC in the fuel vapor pumped by the purge pump to the engine via the vapor line; and a controller configured to:

(i) determine a desired amount of fuel vapor to deliver to the engine;

(ii) detect an operating condition of the engine where engine vacuum is less than an appropriate level for delivering the desired amount of fuel vapor to the engine without using the purge pump; and (iii) based on the measured amount of HC and whether the operating condition is detected, control at least one of the purge pump and a purge valve to deliver the desired amount of fuel vapor to the engine, the purge valve being connected between the purge pump and the engine.

2. The EVAP control system of claim 1, wherein the purge pump is configured to pump the fuel vapor during engine-off periods.

3. The EVAP control system of claim 2, wherein the controller is configured to control at least one of the purge pump and the purge valve to deliver the desired amount of fuel vapor to the engine during cold starts in order to mitigate an amount of HC emissions.

4. The EVAP control system of claim 1, wherein the purge valve is connected to an intake port of a cylinder of the engine.

5. The EVAP control system of claim 1, wherein the purge valve is connected to the cylinder.

6. The EVAP control system of claim 1, wherein the controller is configured to control at least one of the purge pump and the purge valve based on a measured ambient temperature.

7. The EVAP control system of claim 1 wherein a precondition for the controller controlling at least one of the purge pump and the purge valve is a key-on event of the vehicle.

8. The EVAP control system of claim 1, wherein a precondition for the controller controlling at least one of the purge pump and the purge valve is a rotational speed of the purge pump exceeding a threshold.

9. The EVAP control system of claim 1, wherein a precondition for the controller controlling at least one of the purge pump and the purge valve is the HC sensor being turned on.

10. The EVAP control system of claim 9, wherein the precondition further includes the measured amount of HC being greater than a minimum threshold for combustion by the engine.

11. The EVAP control system of claim 1, wherein the controller is further configured to control fuel injectors of the engine to deliver the liquid fuel from the fuel tank after a period of controlling at least one of the purge pump and the purge valve to deliver the desired amount of fuel vapor to the engine.

12. The EVAP control system of claim 1, wherein the controller is configured to control both the purge pump and the purge valve to deliver the desired amount of fuel vapor to the engine.

13. The EVAP control system of claim 1, wherein the controller is configured to control a rotational speed of the purge pump and an angular opening of the purge valve.

14. The EVAP control system of claim 1, wherein the measured amount of HC in the fuel vapor is indicative of a portion of the fuel vapor that is combustible, and wherein the controller is configured to utilize the combustible portion of the fuel vapor in controlling at least one of the purge pump and the purge valve.

15. The EVAP control system of claim 1, wherein the controller is configured to:

determine an ambient temperature of the vehicle;

detect a cold start condition when the ambient temperature is less than a predetermined temperature threshold; and in response to detecting the key-on event and the cold start condition, controlling the purge pump and the purge valve based on measurements from the hydrocarbon (HC) sensor to deliver a desired amount of fuel vapor to the engine.

* * * * *